US006030419A

United States Patent [19]

Strahm

[11] Patent Number: 6,030,419

[45] Date of Patent: Feb. 29, 2000

[54] DYEING PROCESS FOR POLYESTER-CONTAINING FIBRE MATERIALS

[75] Inventor: Ulrich Strahm, Aesch, Switzerland

[73] Assignee: Ciba Specialty Chemicals Corporation, Tarrytown, N.Y.

[21] Appl. No.: 09/162,789

[22] Filed: Sep. 29, 1998

[30] Foreign Application Priority Data

Oct. 1, 1997 [EP] European Pat. Off. ..... 97810723

[51] Int. Cl.[7] ..... D06P 3/82

[52] U.S. Cl. ..... 8/532; 8/582; 8/609; 8/922; 8/576; 8/533

[58] Field of Search ..... 8/576, 609, 611, 8/922, 533, 532, 582

[56] References Cited

U.S. PATENT DOCUMENTS

| | | | |
|---|---|---|---|
| Re. 29,577 | 3/1978 | Hederich et al. . | |
| 3,738,801 | 6/1973 | Blackwell . | |
| 3,744,967 | 7/1973 | Thackrah . | |
| 3,759,963 | 9/1973 | McGuire . | |
| 4,071,468 | 1/1978 | Abel et al. | 252/321 |
| 4,568,351 | 2/1986 | Palliero Cardona | 8/582 |
| 5,705,476 | 1/1998 | Hoffarth | 510/535 |

FOREIGN PATENT DOCUMENTS

| | | |
|---|---|---|
| 0667376 | 8/1995 | European Pat. Off. . |
| 1355102 | 5/1975 | United Kingdom . |
| 2155004 | 9/1985 | United Kingdom . |

OTHER PUBLICATIONS

Chem. Abstr. 100:140761g of JP Kokai 58–174687 Oct. 13, 1983.

Chem. Abstr. 93:187688r Nov. 17, 1980.

*Primary Examiner*—Margaret Einsmann
*Attorney, Agent, or Firm*—Kevin T. Mansfield

[57] ABSTRACT

A process is described for dyeing polyester-containing fibre materials with disperse dyes, which comprises dyeing the polyester-containing fibre materials by a high-temperature dyeing process with a liquor comprising at least one disperse dye and at least one diffusion accelerator selected from the group of the aliphatic glycol ether derivatives.

10 Claims, No Drawings

DYEING PROCESS FOR POLYESTER-CONTAINING FIBRE MATERIALS

The present invention relates to a dyeing process for polyester-containing fibre materials in the presence of specific diffusion accelerators.

The carriers and/or diffusion accelerators based on aromatic compounds which are usually used in dyeing processes and, in particular, in high-temperature dyeing processes (abbreviated dyeing method) for polyester and polyester-containing fibre materials often adversely affect the light fastness, especially the fastness to hot light, of the dyeings. Accordingly, the known high-temperature dyeing processes for polyester fibre materials are suitable only to a limited extent for fields of application requiring good fastness to hot light, for example in the automobile sector.

There is thus a need for diffusion accelerators which make it possible to use a high-temperature dyeing process for polyester fibre materials and which at the same time do not show any negative effects regarding the light fastness properties of the resulting dyeings.

Surprisingly, it has been found that highly lightfast dyeings can be obtained on polyester fibre materials by using the high-temperature dyeing process of this invention.

Accordingly, this invention relates to a process for dyeing polyester-containing fibre materials with disperse dyes, which comprises dyeing the polyester-containing fibre materials by a high-temperature dyeing process with a liquor comprising at least one disperse dye and at least one diffusion accelerator selected from the group consisting of the aliphatic glycol ether derivatives.

In accordance with this invention, a high-temperature dyeing method is understood to be a dyeing process which is carried out in the temperature range from 100 to 140° C.

The aliphatic glycol ether derivatives used in the novel process conform to formula $$R—O—(\text{alkylene}—O)_n—W \quad (1)$$

wherein R is hydrogen, $C_1$–$C_4$alkyl or vinyl, and W, independently of R, has the meaning of R or is acyl, "alkylene" is an alkylene radical containing 2 to 4 carbon atoms, preferably an ethylene or propylene radical, and n is a number from 1 to 24.

The aliphatic glycol derivatives used in the novel process preferably conform to formula $$R—O—(CH_2CH_2O)_n—W \quad (1'),$$

wherein R, W and n have the meanings given for formula (1).

R and W defined as $C_1$–$C_4$alkyl are methyl, ethyl, n-propyl, isopropyl, n-butyl, sec-butyl, iso-butyl and tert-butyl.

W defined as acyl is typically formyl or, preferably, acetyl.

W preferably has the meaning of R, independently of R.

n is preferably a number from 1 to 8.

The following aliphatic glycol ether derivatives are particularly suitable for the novel high-temperature dyeing process:

$H_5C_2—O—(CH_2CH_2O)_2—H$ (ethyldiethylene glycol) (1a), $H_9C_4—O—(CH_2CH_2O)—H$ (butyl glycol) (1b), $HO—(CH_2CH_2CH_2—O)_2—H$ (dipropylene glycol) (1c), $H_3C—O—(CH_2CH_2O)_2—H$ (methyldiethylene glycol) (1d), $H_9C_4—O—(CH_2CH_2O)_2—H$ (butyldiethylene glycol) (1e), $H_5C_2—O—(CH_2CH_2O)_2—C_2H_5$ (diethyldiethylene glycol) (1f), $HO—(CH_2CH_2O)_2—H$ (diethylene glycol) (1g), $H_2C{=}CH—O—(CH_2CH_2O)_2—CH{=}CH_2$ (divinyldiethylene glycol) (1h), $HO—(CH_2CH_2O)_3—H$ (triethylene glycol) (1i)

$H_9C_4—O—(CH_2CH_2O)_3—H$ (butyltriethylene glycol) (1j), $H_3C—O—(CH_2CH_2O)_3—H$ (methyltriethylene glycol) (1k), $H_3C—O—(CH_2CH_2O)_3—CH_3$ (dimethyltriethylene glycol) (1l)

and $(CH_3)_3COCH_2CH(OH)CH_3$ (tert-butylpropylene glycol) (1m).

Other aliphatic glycol ether derivatives suitable for the novel high-temperature dyeing process are those of formulae $H_9C_4—O—(CH_2CH_2O)_2COCH_3$ (butyl diglycol acetate) (1n), $H_5C_2—O—(CH_2CH_2O)—COCH_3$ (ethyl glycol acetate) (1o)

and $H_9C_4—O—(CH_2CH_2O)—COCH_3$ (butyl glycol acetate) (1p).

Other compounds likewise suitable for the novel high-temperature dyeing process are dipropylene glycol monomethyl ether, dipropylene glycol mono-n-butyl ether, dipropylene glycol dimethyl ether, tripropylene glycol monomethyl ether and tripropylene glycol-mono-n-butyl ether.

The glycol ether derivatives of formulae (1a) to (1p), as well as dipropylene glycol monomethyl ether, dipropylene glycol mono-n-butyl ether, dipropylene glycol dimethyl ether, tripropylene glycol monomethyl ether and tripropylene glycol mono-n-butyl ether, are commonly known compounds.

The aliphatic glycol ether derivatives are usually present in the treatment liquor or dyeing liquor in an amount of 0.1 to 5 g/l liquor, preferably of 0.2 to 2 g/l liquor, more preferably of 0.5 to 1 g/l liquor.

Dyes suitable for use in the novel high-temperature dyeing process are disperse dyes which are insoluble or only sparingly soluble in water. These dyes may be from different dye classes, such as from the acridone, azo, anthraquinone, coumarine, methine, perinone, naphthoquinonimine, quinophthalone, styryl or nitro dyes. Said dyes are, for example, those called "disperse dyes" in Colour Index, 3rd Edition (I971), Vol. 2, pages 2483 to 2741. It is also possible to use mixtures of different disperse dyes.

Dyes preferably used for the novel high-temperature dyeing process are those of formula (2)

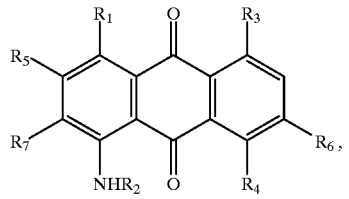

wherein $R_1$ is hydroxy or amino, $R_2$ is hydrogen; phenyl which is unsubstituted or substituted by $C_1$–$C_4$alkyl, $C_1$–$C_4$alkoxy, hydroxy-$C_1$–$C_4$alkyl or $C_1$–$C_4$alkylsulfo; phenylsulfoxy which is unsubstituted or substituted by $C_1$–$C_4$alkyl, $C_1$–$C_4$alkoxy, hydroxy-$C_1$–$C_4$alkyl or $C_1$–$C_4$alkylsulfo, $R_3$ is hydrogen, hydroxy, amino or nitro, $R_4$ is hydrogen, hydroxy, amino or nitro, $R_5$ is hydrogen, halogen or $C_1$–$C_4$alkoxy, $R_6$ is hydrogen, halogen or —O—$(CH_2)_2$—O—$COOR_8$, wherein $R_8$ is $C_1$–$C_4$alkyl or phenyl, and $R_7$ is hydrogen or the radical —O—$C_6H_5$—$SO_2$—NH—$(CH_2)_3$—O—$C_2H_5$, (3)

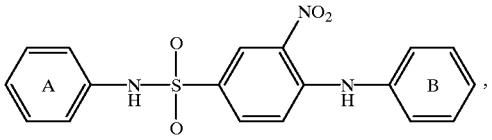

wherein the rings A and B are unsubstituted or mono- or polysubstituted by halogen, (4)

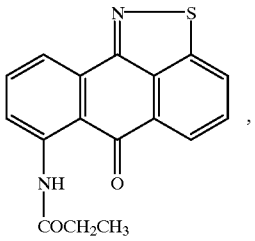

(5)

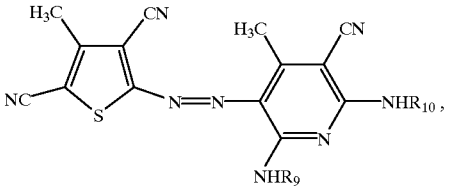

wherein $R_9$ and $R_{10}$ are each independently of the other hydrogen, —$(CH_2)_2$—O—$(CH_2)_2$—OX or —$(CH_2)_3$—O—$(CH_2)_4$—OX, wherein X is hydrogen or —$COCH_3$, (6)

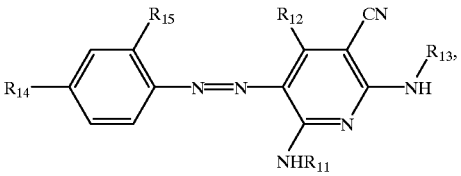

wherein $R_{11}$ is $C_1$–$C_4$alkyl which is unsubstituted or substituted by hydroxy or $C_1$–$C_4$alkoxy, $R_{12}$ is $C_1$–$C_4$alkyl, $R_{13}$ is the radical of formula —$(CH_2)_3$—O—$(CH_2)_2$—O—$C_6H_5$, $R_{14}$ is halogen, nitro or cyano, and $R_{15}$ is hydrogen, halogen, nitro or cyano, (7)

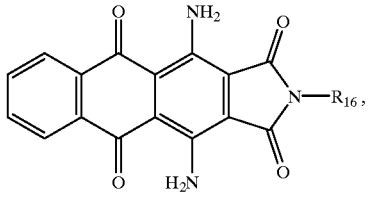

wherein $R_{16}$ is $C_1$–$C_4$alkyl which is unsubstituted or substituted by $C_1$–$C_4$alkoxy, $C_1$–$C_2$alkoxy-$C_1$–$C_4$-alkoxy or hydroxy, (8)

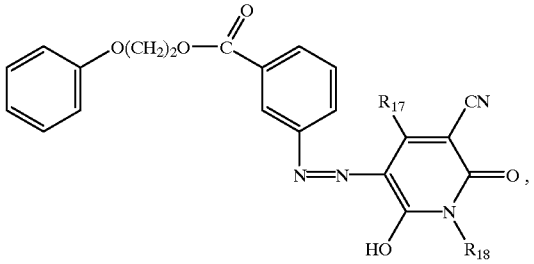

wherein $R_{17}$ and $R_{18}$ are each independently of the other $C_1$–$C_4$alkyl, and (9)

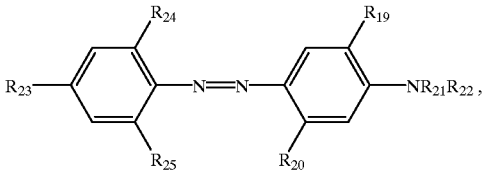

$R_{19}$ is hydrogen, halogen, $C_1$–$C_4$alkyl or $C_1$–$C_4$alkoxy, $R_{20}$ is hydrogen, halogen or acylamino, $R_{21}$ and $R_{22}$ are each independently of the other $C_1$–$C_4$alkyl which is unsubstituted or substituted by hydroxy, cyano, $C_1$–$C_4$alkoxycarbonyl or acetoxy, and $R_{23}$ is halogen, nitro or cyano, $R_{24}$ is hydrogen, halogen, nitro or cyano, and $R_{25}$ is hydrogen, halogen or cyano.

The dyes of formulae (2) to (9) can be used singly or also as mixtures with one another or with other dyes. The above dyes of formulae (2) to (9) are known or can be prepared by known methods.

The disperse dyes are usually present in the dye liquors in the form of a fine dispersion. Suitable dispersants for the preparation of this dispersion are those customarily used for dyeing with disperse dyes, for example those cited in EP-A-0 280 654 as dispersants. The disperse dyes are expediently converted to a dye formulation before their use. To this purpose the dye is ground to an average particle size from 0.1 to 10 micron. Grinding can be carried out in the presence of dispersants. The dye is ground, for example, with a dispersant or is kneaded in paste form with a dispersant and then dried under vacuum or by atomising. After adding water, the formulations so obtained can be used to prepare dye baths.

The amount of the dyes used depends on the desired shade. In general, amounts from 0.01 to 15, preferably from 0.02 to 10, more preferably from 0.1 to 5 % by weight, based on the weight of the polyester-containing fibre material, have been found useful.

Polyester-containing fibre materials which can be dyed according to this invention are understood to be, for example, cellulose ester fibres, such as cellulose-21/2-acetate fibres and cellulose-21/2-triacetate fibres and, in particular, linear polyester fibres which may possibly be acid-modified, which fibres are obtained, for example, by condensing terephthalic acid with ethylene glycol, or isophthalic acid or terephthalic acid with 1,4-bis(hydroxymethyl) cyclohexane, and also fibres of mixed polymers of terephthalic and isophthalic acid and ethylene glycol. It is preferred to use linear polyester fibre material of terephthalic acid and ethylene glycol.

The fibre materials can also be dyed by the novel process as blends with one another or with other fibres, for example mixtures of polyacrylonitrile/polyester, polyamide/polyester, polyester/cotton and, in particular, of polyester/cellulose and polyester/wool.

The polyester-containing fibre material can be in different forms of presentation. Piece goods, such as wovens, knits or webs, are preferred.

The dyeings are carried out from an aqueous liquor by the exhaust process, and the liquor ratio can be chosen from a wide range, for example from 1:4 to 1:100, preferably from 1:6 to 1:50. The temperature at which dyeing is carried out according to this invention is in the range from 100 to 140° C., preferably from 110 to 130° C.

The dyeing time is from 5 to 25 minutes, preferably from 10 to 20 minutes.

The dye liquors can additionally comprise other additives, for example dyeing auxiliaries, dispersants, wetting agents and antifoams.

The dye liquors may also comprise mineral acids, such as sulfuric acid or phosphoric acid, or conveniently also organic acids, for example formic acid or acetic acid and/or salts, such as ammonium acetate or sodium sulfate. The acids mainly serve to adjust the pH of the dye liquors which is preferably in the range from 4 to 5.

The process of this invention gives dyeings of good colour strength, good fastness to washing and very good fastness to light and hot light.

The invention is illustrated by the following Examples. Parts and percentages are by weight, and temperatures are given in degrees Celsius. The ratio of parts by weight and parts by volume is the same as that between the gramme and the cubic centimeter.

EXAMPLE 1

In a conventional laboratory dyeing apparatus, a 10 g piece of polyester fabric is treated at a liquor ratio of 1:20 in a liquor comprising 0.105 g of the dye of formula (10)

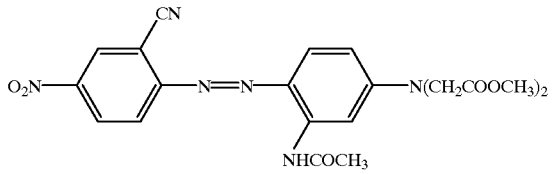

and 0.5 g/l of ethyldiethylene glycol, which is adjusted to pH 5 with acetic acid.

To this purpose, ethyldiethylene glycol is placed in the laboratory dyeing apparatus and then the aqueous dye dispersion, adjusted to pH=5, is added stepwise while stirring vigorously. The homogeneous liquor is then heated to 60° C. and the piece of polyester fabric is added. After 15 minutes, the dye bath is heated to 140° C. over 25 minutes and the polyester tricot is dyed at this temperature for 90 minutes. The liquor is then cooled over 10 minutes to 70° C. and the dyed piece of polyester is rinsed with cold water and subjected to a reductive purification by being treated with a liquor comprising 2 ml/l of a 36% aqueous solution of NaOH and 3 g/l of sodium dithionite for 20 minutes at 75° C. The piece of polyester is then rinsed with warm and cold water, centrifuged and dried at 80° C. A highly coloured red dyeing is obtained which has good fastness to light and washing.

EXAMPLE 2

The general procedure of Example 1 is repeated, but replacing 0.5 g/l of ethyldiethylene glycol with the equimolar amount of butyl glycol, dipropylene glycol, methyldiethylene glycol, butyldiethylene glycol, diethyldiethylene glycol, diethylene glycol, divinyldiethylene glycol, triethylene glycol, butyltriethylene glycol, methyltriethylene glycol, dimethyltriethylene glycol or tert-butylpropylene glycol, which also gives a highly coloured red dyeing having good fastness to light and washing.

EXAMPLE 3

The general procedure of Example 1 is repeated, but replacing 0.5 g/l of ethyldiethylene glycol with the equimolar amount of ethyl glycol acetate, butyl diglycol acetate or butyl glycol acetate, which also gives a highly coloured red dyeing having good fastness to light and washing.

EXAMPLE 4

The general procedure of Example 1 is repeated, but replacing 0.5 g/l of ethyldiethylene glycol with the equimolar amount of dipropylene glycol monomethyl ether, dipropylene glycol mono-n-butyl ether, dipropylene glycol dimethyl ether, tripropylene glycol monomethyl ether or tripropylene glycol mono-n-butyl ether, which also gives a highly coloured red dyeing having good fastness to light and washing.

EXAMPLE 5

In a conventional laboratory dyeing apparatus, a 10 g piece of 60/40 polyester/wool fabric is treated at a liquor ratio of 1:20 in a liquor comprising 0.105 g of the dye of formula (10) and 10 g/l of the solution (A) consisting of 9.875 g of acetophenone and 0.125 g of a polyol surfactant based on oleate esters, which is adjusted to pH 5 with acetic acid.

To this purpose, the solution (A) is placed in the laboratory dyeing apparatus and then the aqueous dye dispersion, adjusted to pH=5, is added stepwise while stirring vigorously. The homogeneous liquor is then heated to 60° C. and the piece of polyester/wool fabric is added. After 15 minutes, the dye bath is heated to 120° C. over 25 minutes and the polyester tricot is dyed at this temperature for 90 minutes. The liquor is then cooled to 70° C. over 10 minutes and the dyed piece of polyester/wool fabric is rinsed with cold water and subjected to a reductive purification by being treated with a liquor comprising 2 ml/l of a 36% aqueous solution of NaOH and 3 g/l of sodium dithionite for 20 minutes at 75° C. The piece of polyester/wool is then rinsed with warm and cold water, centrifuged and dried at 80° C. A highly coloured red dyeing is obtained which has good fastness to light and washing.

EXAMPLE 6

The general procedure of Example 5 is repeated, but replacing 9.875 g of acetophenone with the same amount of naphthalene, diphenylmethane, diethyl phthalate, dibutyl phthalate, 1,2,3,4-tetrahydronaphthalene, butyl benzoate, ethyl benzoate, methyl benzoate, diphenyl ether, diethyl fumarate, isopropyl acetate, ethyl cinnamate or quinoline, which also gives highly coloured red dyeings having good fastness to light and washing.

What is claimed is:

1. A process for dyeing polyester-containing fibre materials with disperse dyes, which comprises dyeing the polyester-containing fibre materials by a high-temperature exhaust-dyeing process with a liquor comprising at least one disperse dye and 0.1 to 5 g/l of at least one diffusion accelerator selected from the group consisting of the aliphatic glycol ether derivatives of the formula $$R—O—(\text{alkylene}—O)_n—W \quad (1)$$

wherein R is hydrogen, $C_1$–$C_4$alkyl or vinyl, and W, independently of R, has the meaning of R or is acyl, "alkylene" is an alkylene radical containing 2 to 4 carbon atoms, and n is a number from 1 to 24.

2. A process according to claim 1, wherein "alkylene" is an ethylene or propylene radical.

3. A process according to claim 1, wherein the aliphatic glycol ether derivatives are of formula $$H_5C_2—O—(CH_2CH_2O)_2—H \quad (1a),$$

$$H_9C_4—O—(CH_2CH_2O)—H \quad (1b),$$

$$HO—(CH_2CH_2CH_2—O)_2—H \quad (1c),$$

$$H_3C—O—(CH_2CH_2O)_2—H \quad (1d),$$

$$H_9C_4—O—(CH_2CH_2O)_2—H \quad (1e),$$

$$H_5C_2—O—(CH_2CH_2O)_2—C_2H_5 \quad (1f),$$

$$HO—(CH_2CH_2O)_2—H \quad (1g),$$

$$H_2C{=}CH—O—(CH_2CH_2O)_2—CH{=}CH_2 \quad (1h),$$

$$HO—(CH_2CH_2O)_3—H \quad (1i),$$

$$H_9C_4—O—(CH_2CH_2O)_3—H \quad (1j),$$

$$H_3C—O—(CH_2CH_2O)_3—H \quad (1k)$$

or $$H_3C—O—(CH_2CH_2O)_3—CH_3 \quad (1l).$$

4. A process according to claim 1, wherein the aliphatic glycol ether derivatives are of formula $$H_9C_4—O—(CH_2CH_2O)_2COCH_3 \quad (1n),$$

$$H_5C_2—O—(CH_2CH_2O)—COCH_3 \quad (1o)$$

or $$H_9C_4—O—(CH_2CH_2O)—COCH_3 \quad (1p).$$

5. A process according to claim 1, wherein the aliphatic glycol ether derivatives are dipropylene glycol monomethyl ether, dipropylene glycol mono-n-butyl ether, dipropylene glycol dimethyl ether, tripropylene glycol monomethyl ether or tripropylene glycol mono-n-butyl ether.

6. A process according to claim 1, wherein the disperse dyes are of formula (2)

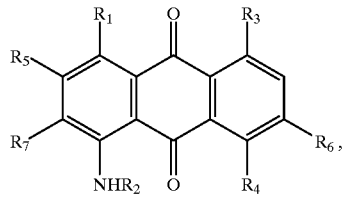

wherein $R_1$ is hydroxy or amino, $R_2$ is hydrogen; phenyl which is unsubstituted or substituted by $C_1$–$C_4$alkyl, $C_1$–$C_4$alkoxy, hydroxy-$C_1$–$C_4$alkyl or $C_1$–$C_4$alkylsulfo; phenylsulfoxy which is unsubstituted or substituted by $C_1$–$C_4$alkyl, $C_1$–$C_4$alkoxy, hydroxy-$C_1$–$C_4$alkyl or $C_1$–$C_4$alkylsulfo, $R_3$ is hydrogen, hydroxy, amino or nitro, $R_4$ is hydrogen, hydroxy, amino or nitro, $R_5$ is hydrogen, halogen or $C_1$–$C_4$alkoxy, $R_6$ is hydrogen, halogen or $—O—(CH_2)_2—O—COOR_8$, wherein $R_8$ is $C_1$–$C_4$alkyl or phenyl, and $R_7$ is hydrogen or the radical $—O—C_6H_5—SO_2—NH—(CH_2)_3—O—C_2H_5$, or of formula (3)

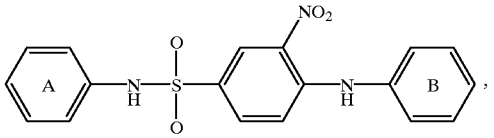

wherein the rings A and B are unsubstituted or mono- or polysubstituted by halogen, or of formula (4)

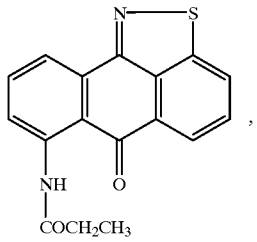

or of formula (5)

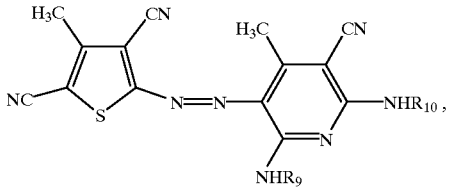

wherein $R_9$ and $R_{10}$ are each independently of the other hydrogen, $—(CH_2)_2—O—(CH_2)_2—OX$ or $—(CH_2)_3—O—(CH_2)_4—OX$, wherein X is hydrogen or $—COCH_3$, or of formula (6)

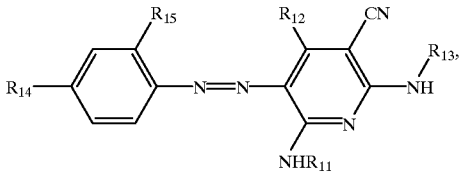

wherein $R_{11}$ is $C_1$–$C_4$alkyl which is unsubstituted or substituted by hydroxy or $C_1$–$C_4$alkoxy, $R_{12}$ is $C_1$–$C_4$alkyl, $R_{13}$ is the radical of formula $—(CH_2)_3—O—(CH_2)_2—O—C_6H_5$, $R_{14}$ is halogen, nitro or cyano, and $R_{15}$ is hydrogen, halogen, nitro or cyano, or of formula (7)

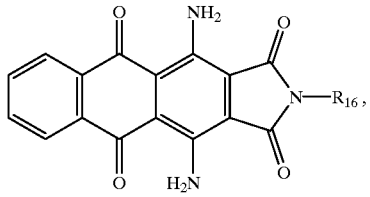

wherein $R_{16}$ is $C_1$–$C_4$alkyl which is unsubstituted or substituted by $C_1$–$C_4$alkoxy, $C_1$–$C_2$alkoxy$C_1$–$C_4$alkoxy or hydroxy, or of formula (8)

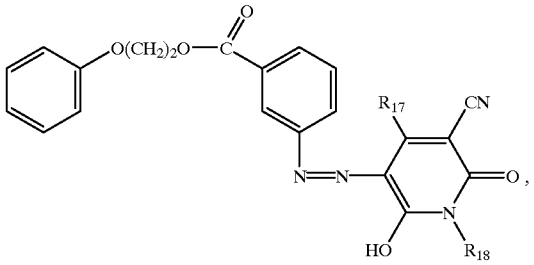

wherein $R_{17}$ and $R_{18}$ are each independently of the other $C_1$–$C_4$alkyl, or of formula (9)

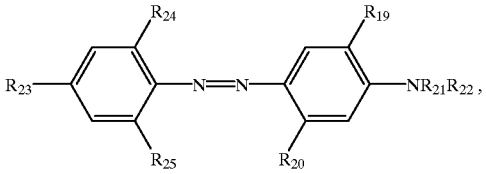

wherein $R_{19}$ is hydrogen, halogen, $C_1$–$C_4$alkyl or $C_1$–$C_4$alkoxy, $R_{20}$ is hydrogen, halogen or acylamino, $R_{21}$ and $R_{22}$ are each independently of the other $C_1$–$C_4$alkyl which is unsubstituted or substituted by hydroxy, cyano, $C_1$–$C_4$alkoxycarbonyl or acetoxy, and $R_{23}$ is halogen, nitro or cyano, $R_{24}$ is hydrogen, halogen, nitro or cyano, and $R_{25}$ is hydrogen, halogen or cyano.

7. A process according to claim 1, which comprises dyeing the polyester-containing fibre materials in the temperature range from 100 to 140° C.

8. A process according to claim 1, wherein the polyester-containing fibre material is 100% polyester fibre material, polyester/wool fibre material and polyester/cellulose fibre material.

9. A process according to claim 8, wherein the polyester-containing fibre material is 100% polyester fibre material.

10. A process according to claim 7, which comprises dyeing the polyester-containing fibre materials in the temperature range from 110 to 130° C.

* * * * *